US006315609B1

(12) United States Patent
Chung

(10) Patent No.: US 6,315,609 B1
(45) Date of Patent: Nov. 13, 2001

(54) STRUCTURE UNIVERSAL SERIAL BUS CONNECTOR FEMALE SOCKET

(75) Inventor: Pei-Sung Chung, Chung-Ho (TW)

(73) Assignees: North Star Systems Corp.; Alcor Micro Corp., both of Chung Ho (TW)

( * ) Notice: Subject to any disclaimer, the term of this patent is extended or adjusted under 35 U.S.C. 154(b) by 0 days.

(21) Appl. No.: 09/639,977

(22) Filed: Aug. 17, 2000

(51) Int. Cl.[7] ..... H01R 13/648
(52) U.S. Cl. ..... 439/607; 439/465; 439/95
(58) Field of Search ..... 439/607–610, 439/95, 701, 456, 457, 465, 906

(56) References Cited

U.S. PATENT DOCUMENTS 5,433,633 * 7/1995 Matsumoto et al. ..... 439/607
6,036,543 * 3/2000 Panis et al. ..... 439/607
6,142,828 * 11/2000 Pepe ..... 439/607

* cited by examiner

*Primary Examiner*—Khiem Nguyen

(57) ABSTRACT

An improved structure universal serial bus (USB) connector female socket in which a grounding ring is disposed at the lower edge of a metal housing enclosing the connector terminals, with the two sides of the metal housing covered by an insulative integument to form the USB connector female socket. The grounding ring can be fastened by a screw and, furthermore, the metal construction of the grounding ring strengthens signal transmission, while also providing for grounding capability, thereby enabling the present invention to strengthen bidirectional signal transmission as well as effectively prevent the occurrence of electrostatic discharge (ESD) during computer peripheral (such as scanners, digital cameras, and keyboards, etc.) operation.

3 Claims, 5 Drawing Sheets

STRUCTURE UNIVERSAL SERIAL BUS CONNECTOR FEMALE SOCKET

BACKGROUND OF THE INVENTION

1) Field of the Invention

The invention herein relates to an improved structure universal serial bus (USB) connector female socket in which a grounding ring is disposed at the lower edge of a metal housing enclosing the connector terminals of the socket; the design of the said grounding ring enables the solid connection of the USB connector and, furthermore, strengthens signal transmission to connected peripherals, while providing for the grounding of the peripherals to prevent occurrence of electrostatic discharge (ESD).

2) Description of the Related Art

Universal serial bus (USB) connectors are now widely used as a standard digital transmission serial bus, with many computers and peripheral equipment (such as scanners, digital cameras, keyboards, and other similar peripherals) utilizing the specification for the transmission connector interface.

Since its advantages include the computer connection of different computer peripheral equipment via the same type of connector and the replacement of previous single-application connectors and the shortcomings thereof, USB connectors already provide an integrated connector function for various peripherals which not only provides for transmission speed, construction, and maintenance that is more convenient than conventional single-application connectors (such as COM1, COM2, LPT, and other connection interfaces), but the connector of this type of general-use serial bus has already become designated as a universal serial bus connector.

However, the conventional USB female socket structure consists of connection terminals externally enclosed in a metal housing with two pins at the lower end of the metal housing providing for insertion into the mounting holes of a printed circuit board and, furthermore, a soldering process is utilized to fuse the metal pins to the circuit board and thereby provide for signal and ground continuity.

Existent USB female socket specifications are only applicable to the printed circuit board and due to the fixed or portable installation requirements of some computer peripherals, an additional separate socket embodiment is required and, furthermore, since the electrical wiring connects bidirectional signals, the embodiment difficulty problem at present is how to the mount the USB female socket such that the power source signal ground line is in electrical continuity, which is the aspect improved upon by the invention herein.

The innovative feature of the improved structure USB connector female socket of the invention herein consists of a grounding ring disposed at the lower edge of a metal housing enclosing the connector terminals of the female socket, the grounding ring being utilized for the necessary fastening of the female socket body onto a metal face plate or a printed circuit board with a screw, such that the USB connector is not confined to on-circuit board only embodiments and, furthermore, the grounding ring provides for both mounting and ground signal transmission capabilities.

SUMMARY AND GENERAL DESCRIPTION OF THE INVENTION

The primary objective of the invention herein is to provide a universal serial bus (USB) connector female socket having mounting and installation capabilities that solve the shortcomings of a confined host-object embodiment.

Another objective of the invention herein is to provide a USB connector female socket that has transmissive grounding capabilities and thereby prevents the damaging occurrence of electrostatic discharge (ESD) induced by voltage overloads.

The invention herein is an improved structure USB connector female socket in which a grounding ring is disposed at the lower edge of a metal housing enclosing the connector terminals, the grounding ring capable of being fastened onto a circuit board with a screw and thereby providing a mounting structure and thus via the conductive material of the metal housing strengthening signal transmission and, furthermore, providing grounding capability.

The detailed description and technological content of the invention herein are accompanied by the brief description of the drawings below.

DETAILED DESCRIPTION OF THE INVENTION

Figure 1:
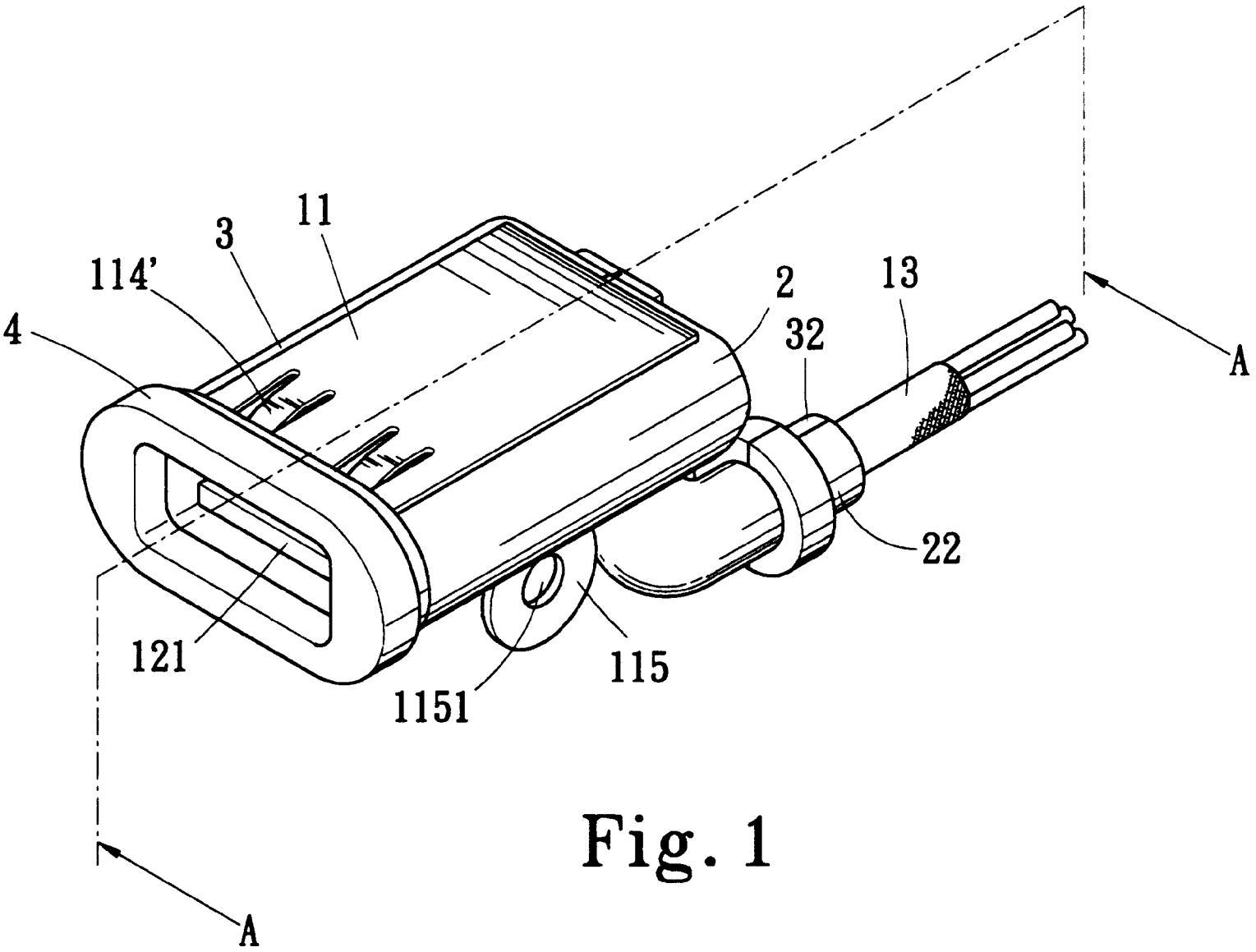
FIG. 1 is an isometric assembly drawing of the invention herein.
Figure 2:
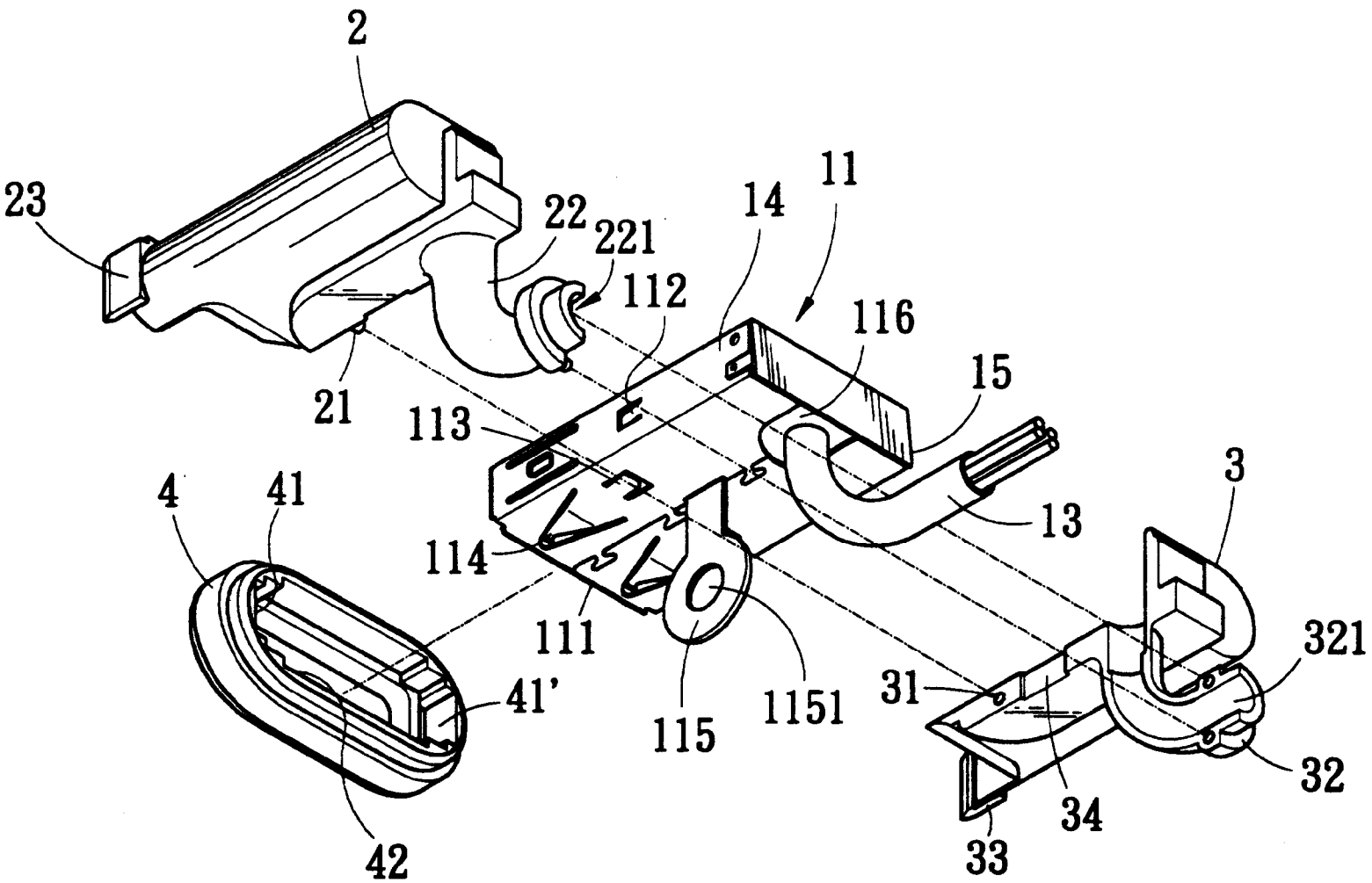
FIG. 2 is an exploded drawing of the invention herein.
Figure 3:
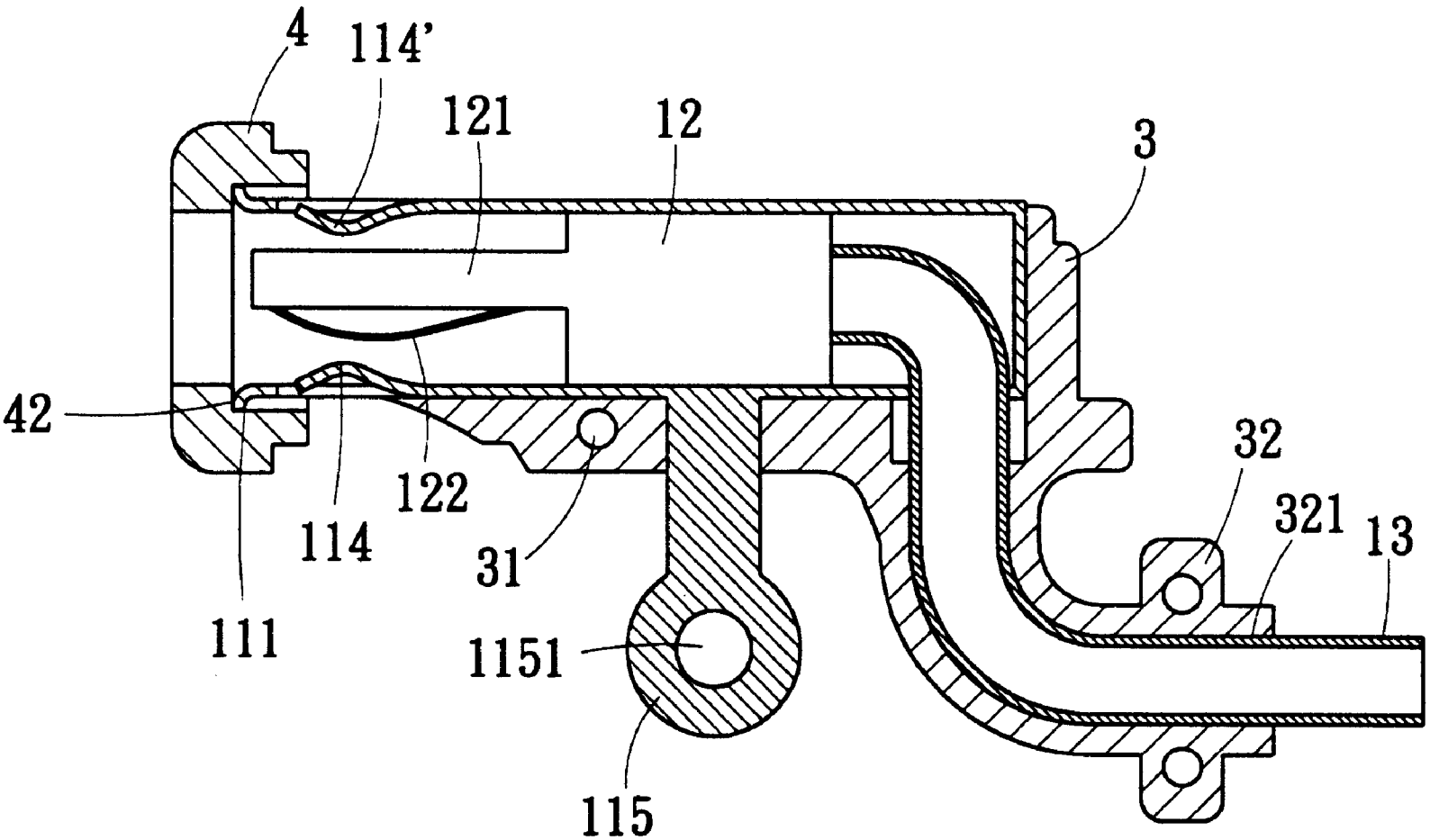
FIG. 3 is a horizontal cross-sectional drawing of the invention herein.

Referring to FIG. 1, FIG. 2, and FIG. 3, the universal serial bus (USB) connector 1 of the invention herein depicted in the said isometric assembly, exploded, and horizontal cross-sectional drawings is comprised of a metal housing 11, two insulative integumentary structural components 2 and 3, and a union socket 4, of which enclosed in the metal housing 11 are connector terminal colloidal cores 12, the said colloidal cores 12 consisting of a columnar body 121 at the connector terminals, with terminals 122 disposed at the lower extent of the said columnar body 121 providing for signal transmission when the connector is inserted and, furthermore, the colloidal cores 12 are positioned along the two sides and lower extent of the wall surfaces of the metal housing 11 by pressure retainer tabs 112 and 113 and, furthermore, formed at the front end opening area of the metal housing 11 is a guide junction section 111 that provides for assembly to the union socket 4.

Additionally situated at each of the corresponding areas of the upper and lower two wall surfaces of the metal housing 11 are clip down sections 114 and 114', the said clip down sections 114 and 114' providing, when the wire conjoinment connector is inserted, for a clip fastening function that prevents the dislodging of the wire conjoimnent connector and, furthermore, extending from the lower extent of the metal housing 11 is a grounding ring 115, the said grounding ring 115 having in it a through-hole 1151 providing for the insertion of a screw when it is fastened and, furthermore, formed in the rear extent of the grounding ring 115 is guide hole 116, the said guide hole 116 providing for the routing of a cable 13 that conducts transmitted signals to the terminals 122.

Each of the said two insulative integumentary structural components 2 and 3 are also one-piece injection molded and correspondingly fabricated, the said integumentary structural components 2 and 3 cover the two wall surfaces 14 and 15 of the connector body 11 and the connector cable 13, with one of the integumentary structural components 2 having disposed a tenon post 21 and the other having disposed a fastening hole 31 at the corresponding area of the tenon post 21, thereby constituting a mounting structure and, furthermore, formed at the lower extent between the two is a notch 34, the said notch 34 providing for the insertion and placement of the grounding ring 115; additionally formed at the lower edge and rear extent of each of the said two integumentary structural components 2 and 3 is a semi-guide tube 22 and 32 and, furthermore, formed along the centers of the semi-guide tubes 22 and 32 are the guide track slots 221 and 321, such that when conjoined by assembly, the two integumentary structural components 2 and 3 cover the two lateral wall surfaces 14 and 15 of the metal housing 11 body, wherein the semi-guide tubes 22 and 32 enshroud the cable 13 extending from the connector.

Furthermore, when the entire USB connector 1 is assembled, the two sides of the metal housing 11 are first covered by the integumentary structural components 2 and 3, with each firmly against the lateral side walls 14 and 15; then, the mounting slots 41 and 41' of the union socket 4 are correspondingly placed at the mounting sections 23 and 33 at the front end of the integumentary structural components 2 and 3, at which time the guide junction section 111 formed at the front end opening area of the metal housing 11 is correspondingly placed at the guide slots 42 and 42' of the union socket 4 such that the entire connector body 11 and the integumentary structural components 2 and 3 are fitted onto the union socket 4 in a state of conjoinment, thereby completing the assembly of the USB connector 1 of the invention herein.

Figure 4:
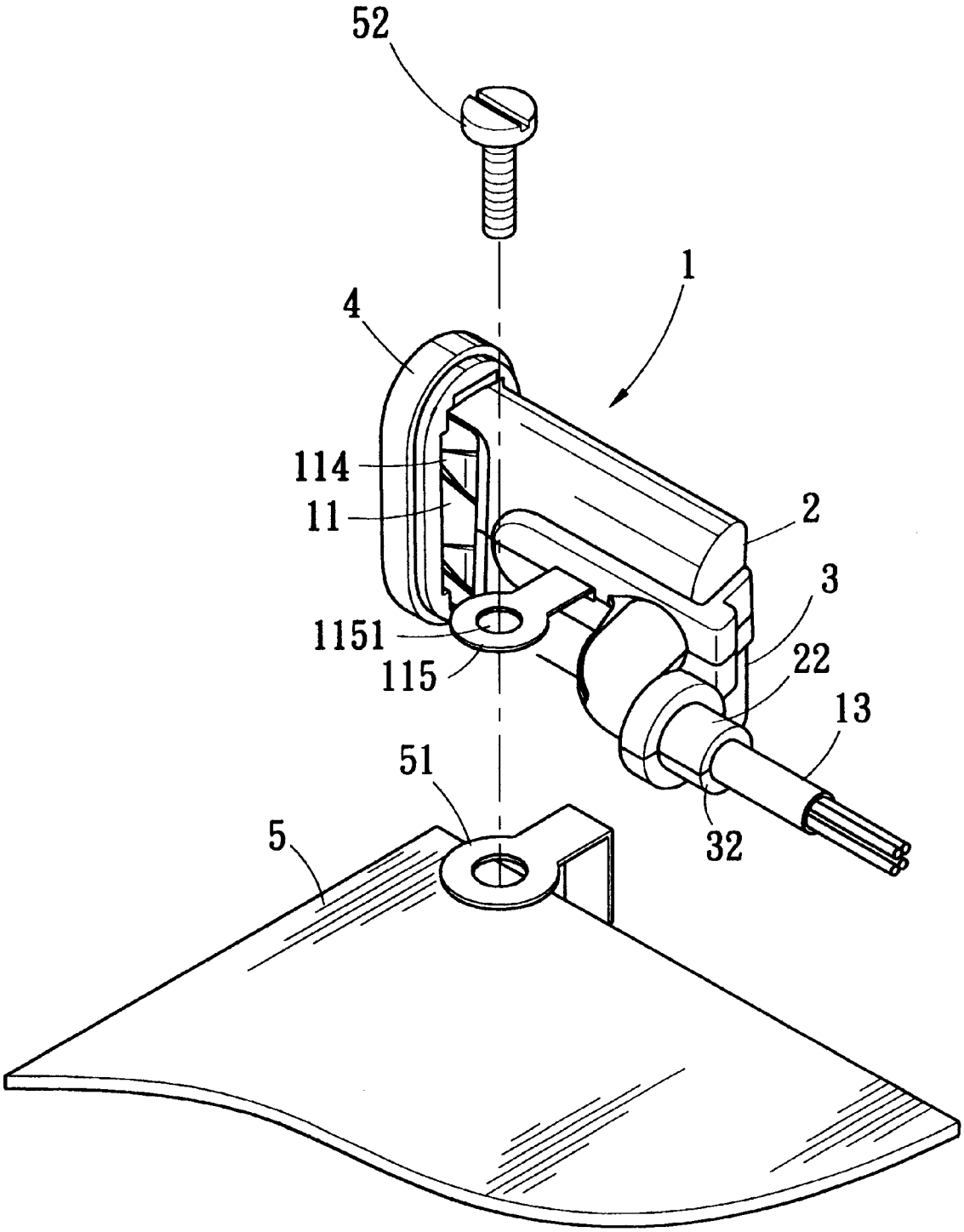
FIG. 4 is an isometric drawing of an application embodiment of the invention herein.

As per the foregoing section and referring to FIG. 4, an application embodiment of the invention herein, the grounding ring 115 extending from the metal housing 11 of the USB connector 1 female socket of the invention herein depicted in the drawing can be mounted by means of a screw 52 inserted and fastened in the through-hole 1151 of an annular tab 51 on a circuit board 5, the said annular tab 51 being in electrical continuity with the metal housing 11 to thereby strengthen signal transmission and, furthermore, provide for grounding capability.

Figure 5:
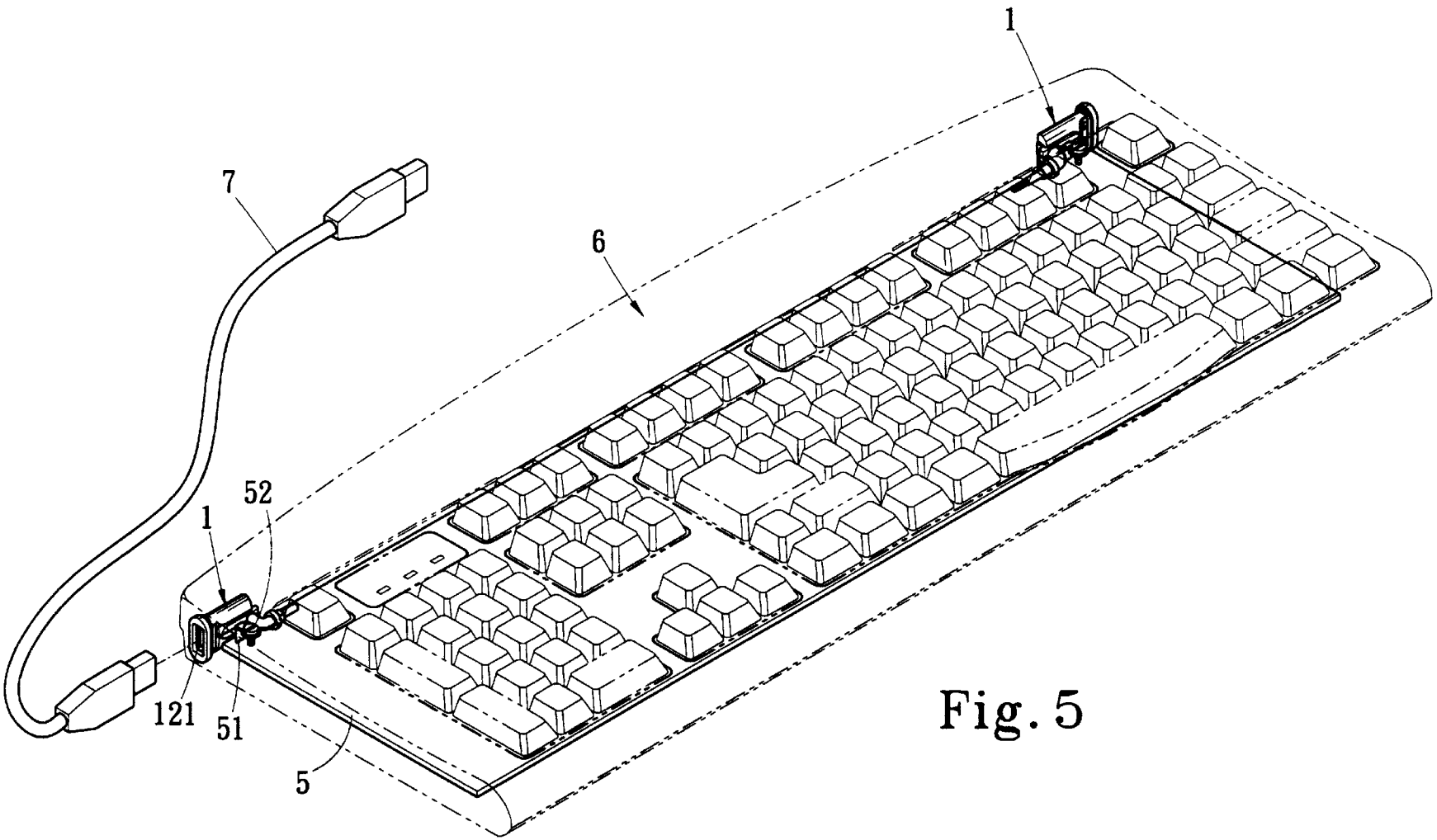
FIG. 5 is an isometric drawing of another application embodiment of the invention herein.

Referring to FIG. 5, another application embodiment of the invention herein, the USB connector 1 female socket of the invention herein depicted in the drawing can be an embodiment on the computer peripheral product keyboard 6, the keyboard 6 being utilized among computer peripherals as the primary inputting device and since it is the most common physical user interface, the grounding capability considerations cannot be overlooked and, therefore, the design of the grounding ring 115 in this embodiment of the invention herein is such that the USB connector 1 female socket can be placed at the two lateral ends of the keyboard 6 and, furthermore, a USB-specification connector cable 7 for transmissions can be similarly fastened as per the said utilization technology onto the circuit board 5 and since the USB connector 1 female socket is no longer confined to being soldered onto the printed circuit board, the grounding ring 115 provides for both mounting and transmissive grounding capabilities.

In summation of the foregoing section, the most preferred embodiment of the invention herein was described to demonstrate its operation and shall not be construed as a limitation of the scope and claims of the invention herein and, furthermore, all modifications and adaptations based on the claims of the patent application of the invention herein shall remain within the patented scope and claims of the present invention.

What is claimed is:

1. An improved structure universal serial bus (USB) connector female socket, the connector of which is comprised of a metal housing, two insulative integumentary structural components, and a union socket, of which the innovative features include:

The said metal housing encloses connector terminals that are also positioned along the two sides and lower extent of the wall surfaces of the said metal housing by pressure retainer tabs and, furthermore, formed at the front end opening area of the said metal housing is a guide junction section that provides for assembly to the said union socket and, furthermore, formed at each of the corresponding areas of the upper and lower two wall surfaces of the said metal housing are a minimum of two or more clip down sections; furthermore, extending from the lower extent of the said metal housing is a grounding ring, the said grounding ring having in it a through-hole, and formed in the rear extent of the said grounding ring is a guide hole, the said guide hole providing for the routing of a cable; the said two insulative integumentary structural components are each one-piece injection molded and correspondingly fabricated, and formed at the lower extent between the two is a notch that provides for the insertion and placement of the said grounding ring; and, additionally formed at the lower edge and rear extent of each of the said two integumentary structural components is a semi-guide tube and, furthermore, formed along the centers of the said semi-guide tubes are guide track slots.

2. As mentioned in claim 1 of the improved structure universal serial bus (USB) connector female socket of the invention herein, the said grounding ring must be constructed of a metal conductive material.

3. As mentioned in claim 1 of the improved structure universal serial bus (USB) connector female socket of the invention herein, the said grounding ring is installed and mounted by means of a fastening component.

* * * * *